US007516783B2

(12) United States Patent
Wintill et al.

(10) Patent No.: US 7,516,783 B2
(45) Date of Patent: Apr. 14, 2009

(54) DOUBLE PIN CONNECTOR AND HYDRAULIC CONNECT WITH SEAL ASSEMBLY

(75) Inventors: Charles David Wintill, Houston, TX (US); Rodney Wayne Long, Cypress, TX (US); William Ryle Darnell, St. Martinville, LA (US); William John Darnell, Houston, TX (US)

(73) Assignee: PetroQuip Energy Services, LLP, Houston, TX (US)

( * ) Notice: Subject to any disclaimer, the term of this patent is extended or adjusted under 35 U.S.C. 154(b) by 0 days.

(21) Appl. No.: 12/105,543

(22) Filed: Apr. 18, 2008

(65) Prior Publication Data

US 2008/0317547 A1 Dec. 25, 2008

Related U.S. Application Data

(63) Continuation-in-part of application No. 11/766,098, filed on Jun. 20, 2007, now Pat. No. 7,373,970.

(51) Int. Cl.
*E21B 19/16* (2006.01)

(52) U.S. Cl. ..... 166/242.6; 166/380

(58) Field of Classification Search ..... 166/380, 166/242.6; 175/320; 285/96, 106, 333, 334; 138/155

See application file for complete search history.

(56) References Cited

U.S. PATENT DOCUMENTS

| | | | | |
|---|---|---|---|---|
| 5,167,282 | A * | 12/1992 | Schneider et al. | 166/297 |
| 5,927,402 | A | 7/1999 | Benson | |
| 5,967,816 | A | 10/1999 | Sampa et al. | |
| 6,026,897 | A * | 2/2000 | Pringle et al. | 166/65.1 |
| 6,983,796 | B2 * | 1/2006 | Bayne et al. | 166/278 |
| 2003/0070817 | A1 * | 4/2003 | Dennistoun et al. | 166/386 |
| 2005/0200127 | A1 * | 9/2005 | Johnson et al. | 285/333 |

* cited by examiner

*Primary Examiner*—Kenneth Thompson
*Assistant Examiner*—Cathleen R Hutchins
(74) *Attorney, Agent, or Firm*—Buskop Law Group, PC; Wendy Buskop

(57) ABSTRACT

A double pin connector with hydraulic connect and seal assembly having a top portion. The top portion has an upper tubular portion. The upper tubular portion engages an intermediate tubular portion. The intermediate tubular portion has an upper flow path in fluid communication with the first hydraulic connector and a plurality of seals comprising at least one second hydraulic flow path seal.

17 Claims, 15 Drawing Sheets

DOUBLE PIN CONNECTOR AND HYDRAULIC CONNECT WITH SEAL ASSEMBLY

CROSS REFERENCE TO RELATED APPLICATIONS

The present application is a Continuation-in-Part application which claims priority to co-pending U.S. patent application Ser. No. 11/766,098, filed Jun. 20, 2007. U.S. patent application Ser. No. 11/766,098 is incorporated herein by reference.

FIELD

The present embodiments relate to a double pin connector with hydraulic connect and seal assembly for use in downhole drilling operations.

BACKGROUND

A need exists for an intelligent completion system for use inside a multi-zone hydrocarbon well.

There further exists a need for a pin connector with seal assembly that can be pulled after use, taken apart, cleaned, and reused.

The present embodiments meet these needs.

BRIEF DESCRIPTION OF THE DRAWINGS

The detailed description will be better understood in conjunction with the accompanying drawings as follows.

Figure 1A:
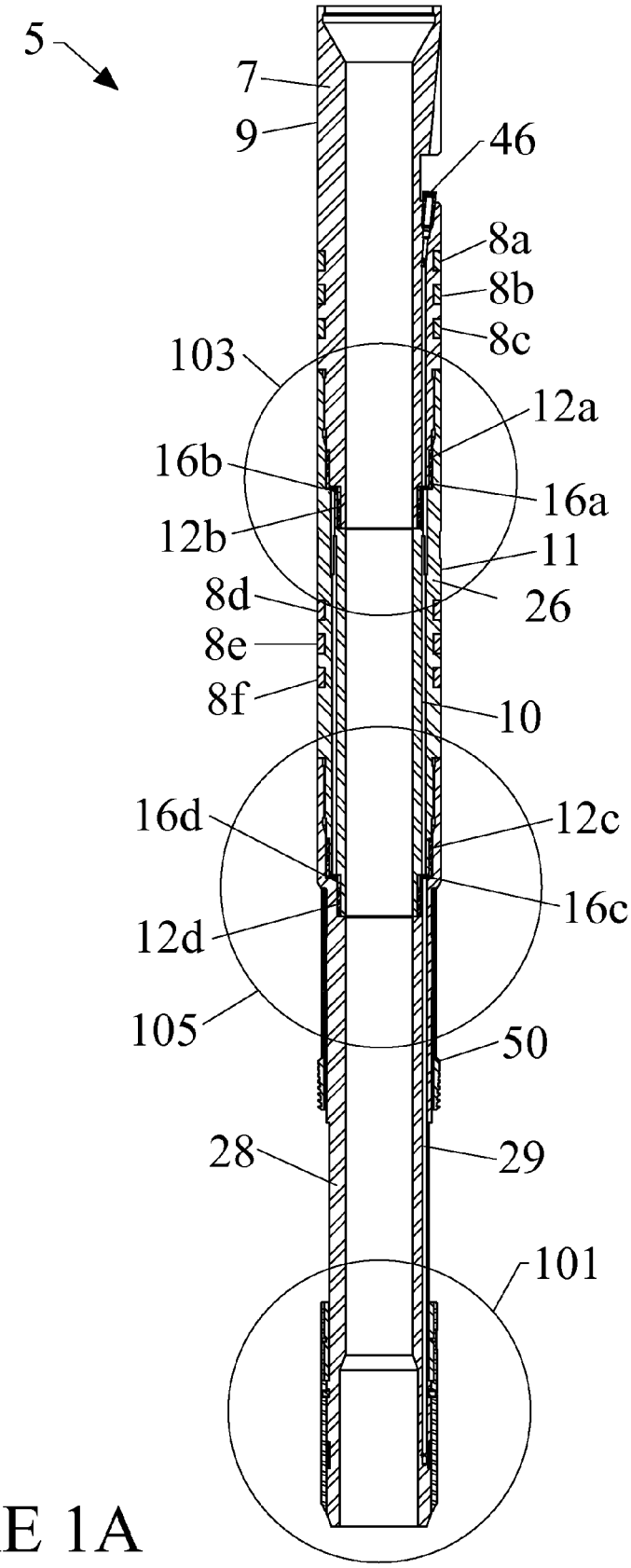
FIG. 1A is a cut view of the top portion of a hydraulic connect and seal assembly.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a double pin connector with hydraulic connect and seal assembly. The double pin connector with hydraulic connect and seal assembly has a top portion of a double pin hydraulic connect and seal assembly.

The top portion of the double pin connector and an upper tubular portion engages an intermediate tubular portion. The intermediate tubular portion has an upper flow path in fluid communication with the first hydraulic connector and a plurality of seals comprising at least one second hydraulic flow path seal.

The top portion has a plurality of upper concentric seals disposed on an outer surface of upper tubular portion and an outer surface of the intermediate tubular portion. The first, second, and third concentric seals can be an elastomeric or non-elastomeric seal. Exemplary elastomeric seals can be purchased from OEM™ Corporation, in Houston, Tex. An exemplary non-elastomeric seal can be purchased from Greene Tweed from Houston, Tex. supplies usable concentric seals for this embodiment.

The first concentric seal, the second concentric seal, and the third concentric seal can be similar to each other. A lower tubular portion fastens to the intermediate tubular portion, and the lower tubular portion comprises an intermediate hydraulic flow path in communication with the upper hydraulic flow path.

A first hydraulic connector is in fluid communication with a fluid supply and fastened to the upper tubular portion. An upper anchor is fastened to the lower tubular portion and a filter, such as a screen with a filtration ranging from about 0.5 microns to about 100 microns. An exemplary filter is commonly used in the industry, and can be purchased from Mott Corporation, located in Farmington, Conn. The filter is secured to the lower tubular portion for providing filtration of the intermediate hydraulic flow path.

The double pin hydraulic connect and seal assembly has a bottom portion. A lower anchor fastens to a first lower tubular body of the bottom portion.

The first lower tubular body has a lower port cover. The port cover can be made out of metal. The port cover can have a diameter from about 2 inches to about 7 inches. A lower actuator surrounds an actuator guide, which is within the lower tubular portion. The actuator can be a spring, a pressure actuator, an electrical actuator, a mechanical actuator, or similar commonly used actuator.

A second lower tubular body is secured to the actuator guide. The second lower tubular body has a lower tubular body face, an outer pin with an outer pin face and fastens to the first lower tubular body.

The second lower tubular body contains a lower hydraulic flow path with a first lower port seal, spaced apart from a second lower port seal with a lower port spacer.

A second hydraulic line connector is in communication with the lower hydraulic flow path, and a lower tubular body seal is disposed between the second lower tubular body and the first lower tubular body.

The second hydraulic line connector connects to a downhole tool, such as a single line sliding sleeve down hole tool assembly, an artificial lift mandrel, and commonly used hydraulic down hole equipment.

The intermediate hydraulic flow path is in fluid communication with the lower hydraulic flow path when the top portion of the hydraulic connect and seal assembly lands within the bottom portion of the hydraulic connect and double pin sub. After the top portion is landed in the bottom portion the down hole tool can be actuated.

A first hydraulic flow path seal can be disposed between the upper tubular portion and the intermediate tubular portion. Further a first seal ring can be disposed between the first hydraulic flow path seal and intermediate tubular portion.

A second seal ring can be disposed between the upper tubular portion and second hydraulic flow path seal.

An upper landing ring can be fastened to the upper port cover. The upper port cover can be fastened to the lower tubular portion. A locking wire can connect the upper port cover to the upper landing ring. An upper fastener can connect the upper port cover to the lower tubular portion.

A barrier seal assembly can be disposed between the lower anchor and the first lower tubular body. The barrier seal assembly can have a barrier seal disposed within a seal housing.

A first lower seal ring and second lower seal ring can be disposed between the first lower tubular body and the second lower tubular body.

The intermediate hydraulic flow path and the upper hydraulic flow path are in continuous fluid communication. The upper anchor removably fastens to the lower anchor when the top portion of hydraulic connect and seal assembly lands within the bottom portion of hydraulic connect and double pin sub.

In another embodiment the seal assembly can be removed and a plurality of hydraulic connectors can communicate with a plurality of hydraulic flow paths with the double pin connector.

Referring now to FIG. 1A, which depicts a top portion 5 of a double pin hydraulic connect and seal assembly. The top portion 5 of a double pin hydraulic connect and seal assembly has an upper tubular portion 7. The upper tubular portion 7 has an outer surface 9. A plurality of concentric seals 8*a*, 8*b*, and 8*c* are disposed on the outer surface 9.

A first hydraulic connector 46, which is adapted to communicate with a hydraulic source, is secured to the upper tubular portion 7. The hydraulic connector 46 is also in fluid communication with an upper hydraulic flow path 10. The upper hydraulic flow path 10 is disposed within an intermediate tubular portion 26. A first hydraulic flow path seal 12*a* is disposed in the upper tubular portion 7. A first seal ring 16*a* is disposed between the first hydraulic flow path seal 12*a* and intermediate tubular portion 26. A second hydraulic flow path seal 12*b* is disposed in the intermediate tubular portion 26. A second seal ring 16*b* is disposed between the upper tubular portion 7 and the second hydraulic flow path seal 12*b*.

Figure 1B:
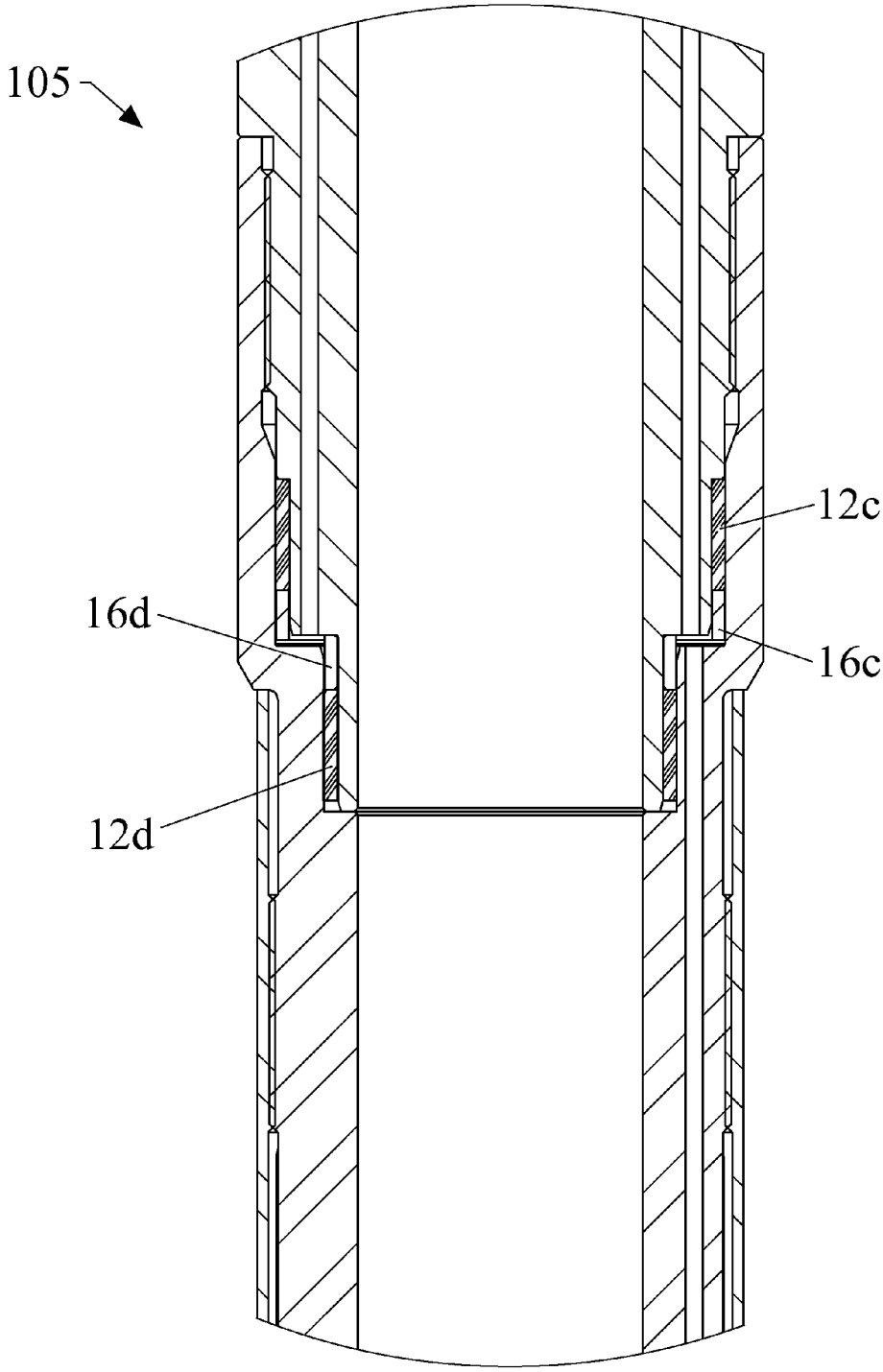
FIG. 1B is a detailed view of the top portion.
Figure 1C:
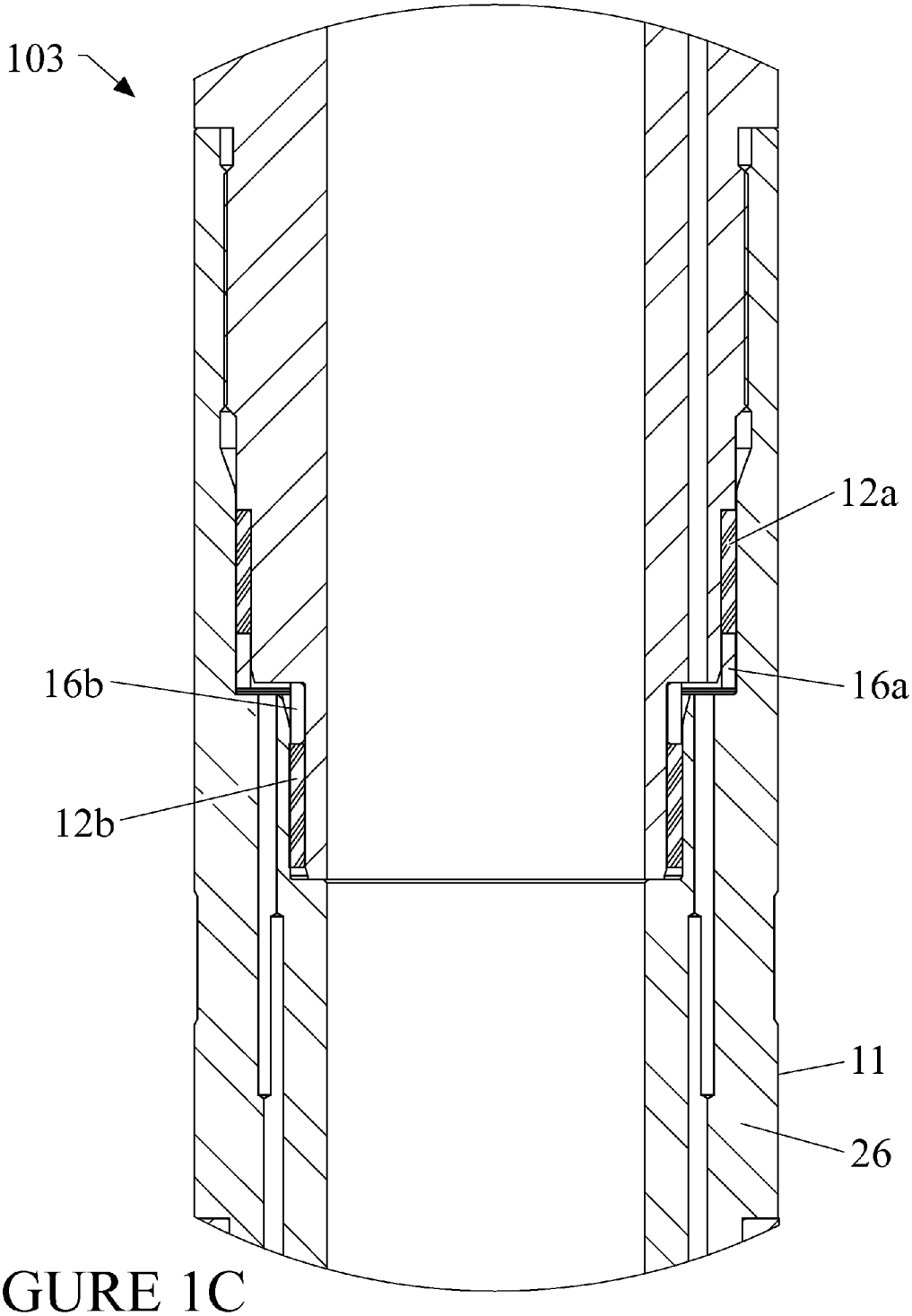
FIG. 1C is a detailed view of a section of the top portion.

In FIG. 1C a detailed view of section 103 can be seen. The detailed view best depicts the first seal ring 16*a*, the first hydraulic flow path seal 12*a*, the second seal ring 16*b*, and the second hydraulic flow path seal 12*b*.

Concentric seals 8*d*, 8*e*, and 8*f* are disposed on an outer portion 11 of an intermediate tubular. The intermediate tubular portion 26 can be duplicated as needed. For example 15 intermediate tubular portions can be used to make the length of the double pin and hydraulic connect with seal assembly longer.

A third seal ring 16*c* is disposed between a third hydraulic flow path seal 12*c* and a lower tubular portion 28. The hydraulic flow path seal 12*c* is disposed on the intermediate tubular portion 26.

A fourth hydraulic flow path seal 12*d* is disposed in the lower tubular portion 28. A fourth seal ring 16*d* is disposed between the intermediate tubular portion 26 and the second hydraulic flow path seal 12*d*. An intermediate flow path 29 is disposed within the lower tubular portion 28. An upper anchor 50 is secured to the lower tubular portion 28. Section 105 is depicted in a detailed view in FIG. 1B. FIG. 1B best depicts the third seal ring 16*c*, the third hydraulic flow path seal 12*c*, the fourth seal ring 16*d*, and the fourth hydraulic flow path seal 12*d*.

Figure 2:
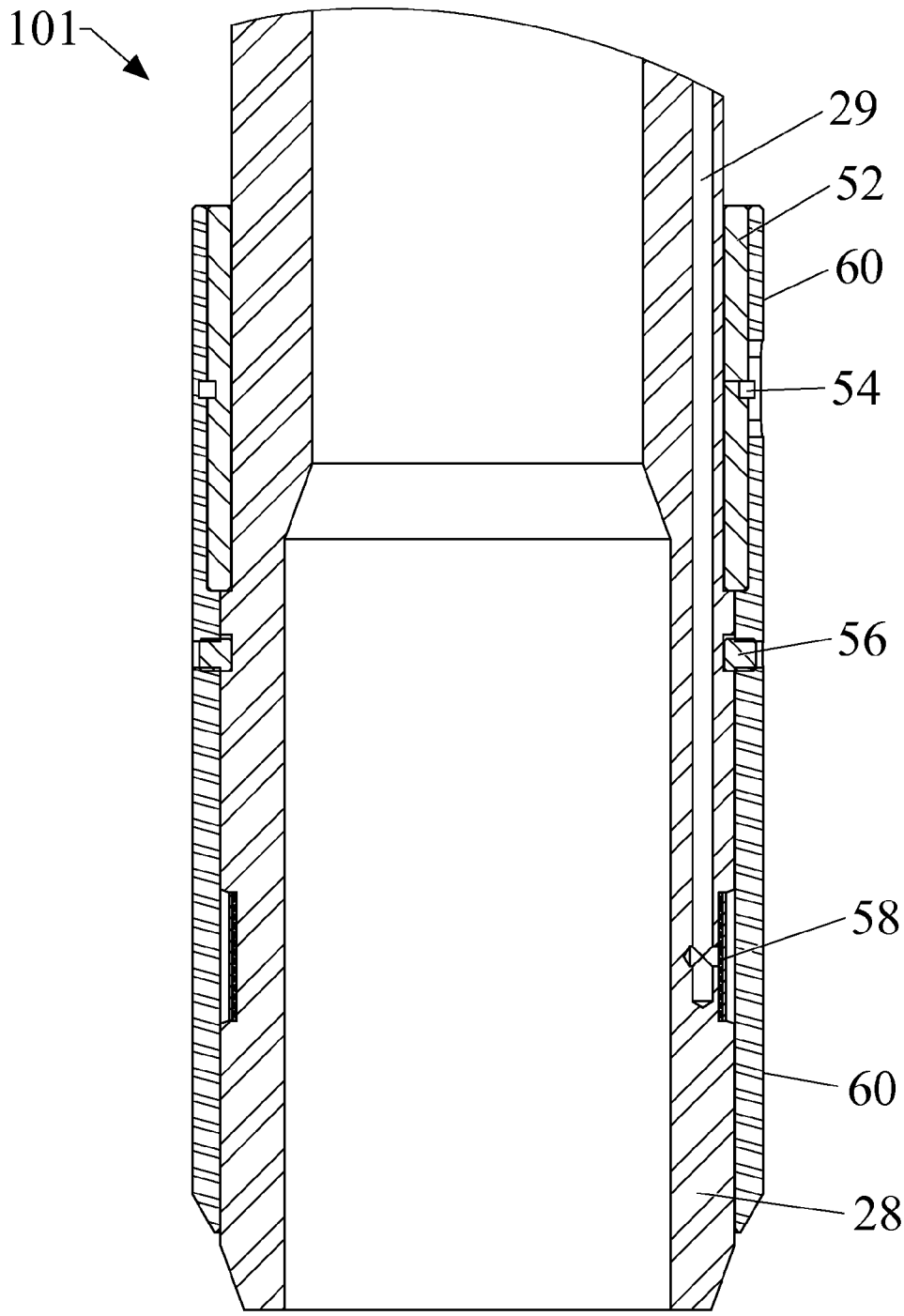
FIG. 2 is a detailed view of an embodiment of a lower tubular portion of the hydraulic connect.

FIG. 2 depicts a detailed view of the lower tubular portion 28. At least one filter 58 is secured to the lower tubular portion 28. The filter 58 provides filtration of the intermediate hydraulic flow path 29.

An upper port cover 60 is depicted secured to the lower tubular portion 28. An upper landing ring 52 is fastened to the upper port cover 60.

A locking wire 54 is secured to the upper port cover 60 and the upper landing ring 52. An upper fastener 56 connects to the upper port cover 60 to the lower tubular portion 28.

Figure 3:
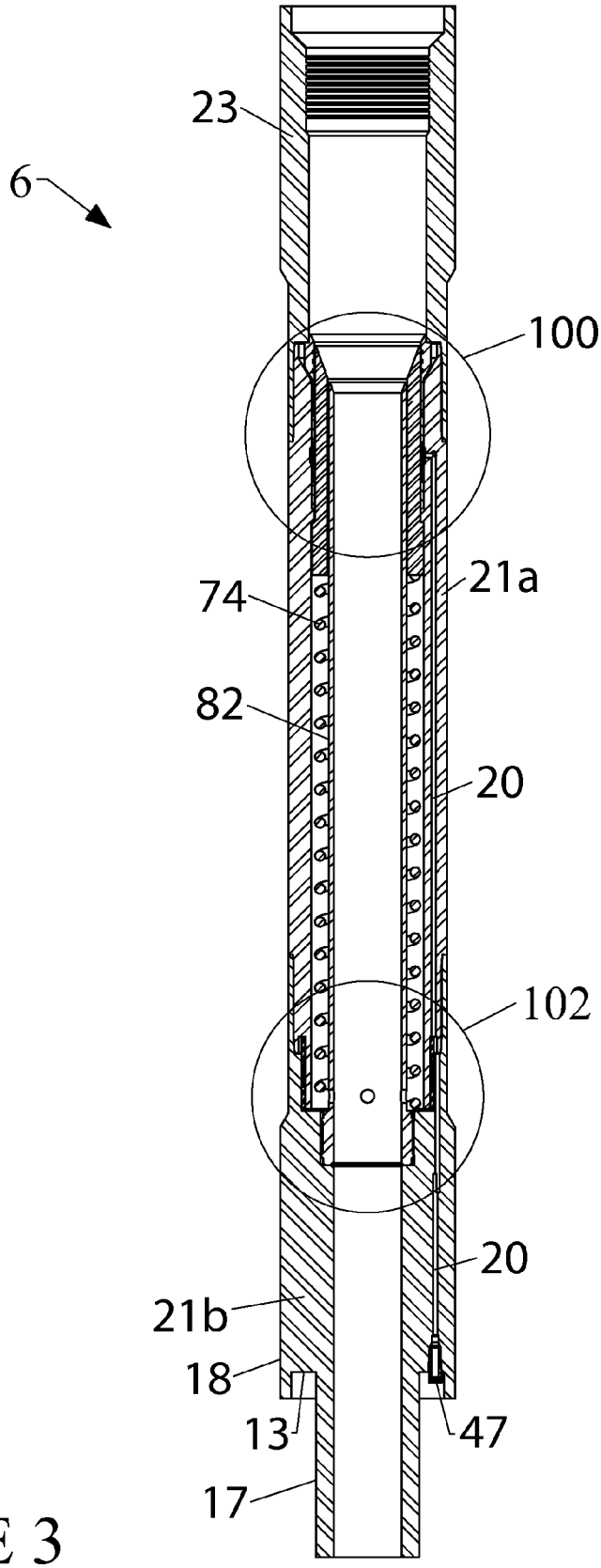
FIG. 3 is a cut view of a bottom portion of the hydraulic connect and double pin connector.

FIG. 3 is a cut view of a bottom portion of the hydraulic connect and double pin connector. The bottom portion 6 has a lower anchor 23. The lower anchor 23 is secured to a first lower tubular body 21*a*. The first lower tubular body 21*a* contains an actuator guide 82. A lower actuator 74 is disposed on the actuator guide 82.

A second lower tubular body 21*b* secures to the actuator guide 82. The lower tubular body 21*b* fastens in a removable fashion to the first lower tubular body 21*a*. The lower tubular body 21*b* contains a lower hydraulic flow path 20.

The lower hydraulic flow path 20 is in fluid communication with a second hydraulic line connector 47. The second hydraulic line connector 47 is adapted to be in fluid communication with a downhole tool.

The second lower tubular body 21*b* has a lower tubular body face 13. An outer pin 18 and an inner pin 17 are part of the second lower tubular body 21*b*.

Figure 4:
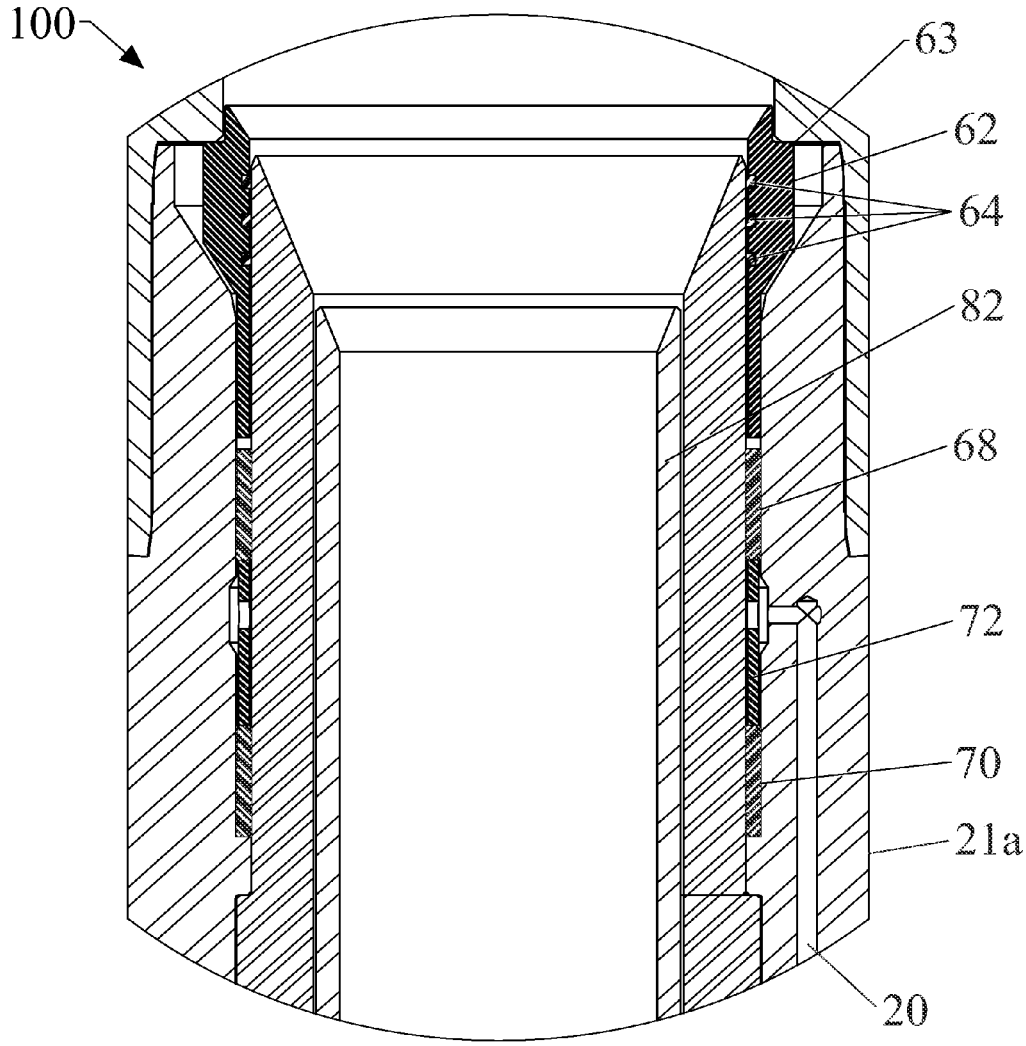
FIG. 4 is a detailed view of a section of the lower tubular body.

Section 100 includes the first lower tubular body 21*a*, this section is best understood with reference to FIG. 4. Section 102 includes a detailed view of the first lower tubular body and the second lower tubular body 21*b*, which can be best seen in FIG. 5.

Referring now to FIG. 4. A first lower port seal 68 is disposed in the first lower tubular body 21*a* for preventing a leakage of flow path 20. A second lower port seal 70 is disposed in first lower tubular body 21*a* to prevent the leakage of flow path 20. The second lower port seal 70 is spaced apart from the first lower port seal 68 by a lower port spacer 72. The lower port spacer is disposed in the hydraulic flow path 20 and can be a cylindrical porous shaft. The lower port spacer can be metal or rubber.

A barrier seal assembly 62 is disposed between the lower anchor 23, best seen in FIG. 3, and the first lower tubular body 21*a*. The barrier seal assembly 62 includes a seal housing 63 and at least one seal 64 disposed within the seal housing 63.

Figure 5:
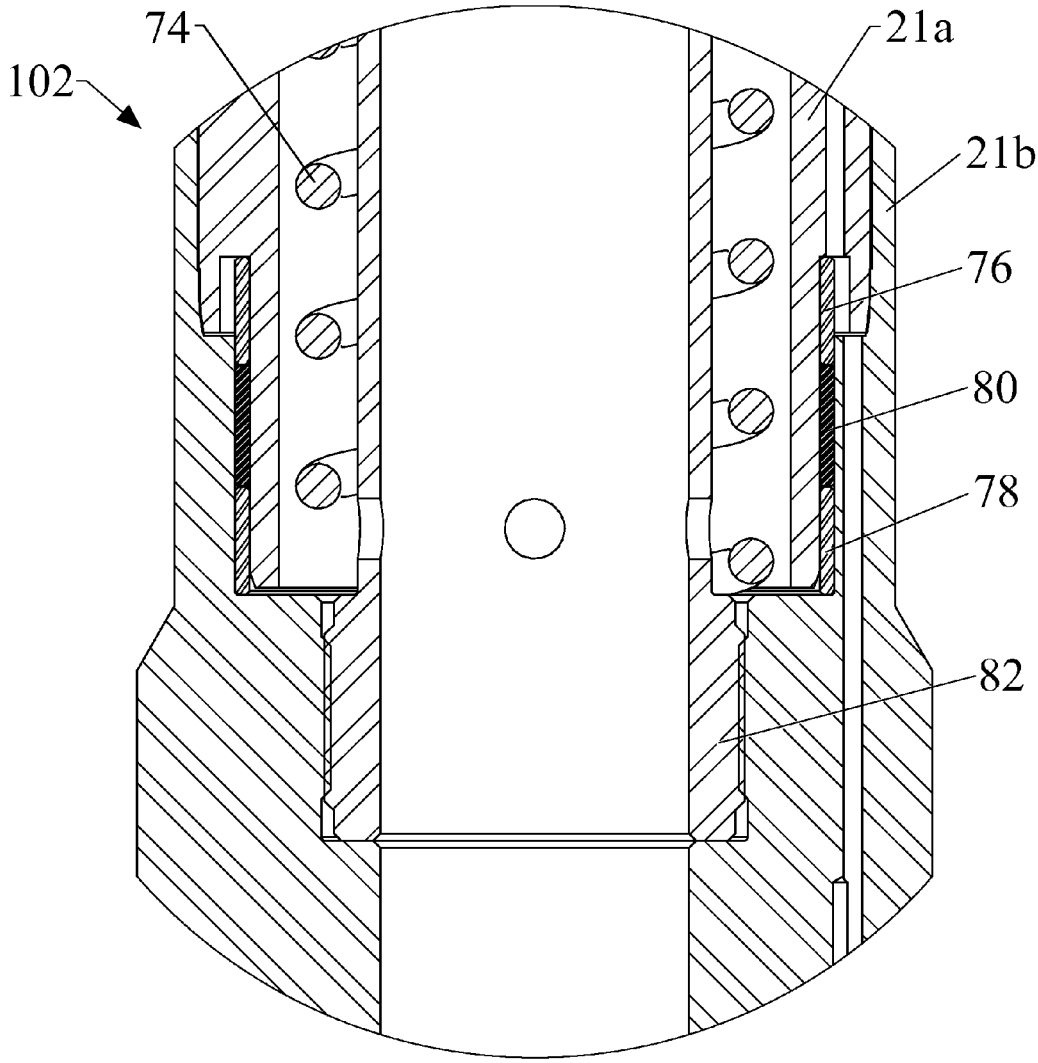
FIG. 5 is a detailed view of another portion of the lower portion of the hydraulic connect.

Referring now to FIG. 5. A first lower seal ring 76 and a second lower seal ring 78 are disposed between the second lower tubular body 21*b* and the first lower tubular body 21*a*. The first lower seal ring 76 and the second lower seal ring 78 can be a metal band used to keep seal assembly 80 in place.

The actuator guide 82 can be seen within the first lower tubular body 21*a* and secured to the second lower tubular body 21*b*. The actuator guide 82 is within the first lower tubular body 21*a* and is surrounded by an actuator 74.

Figure 6:
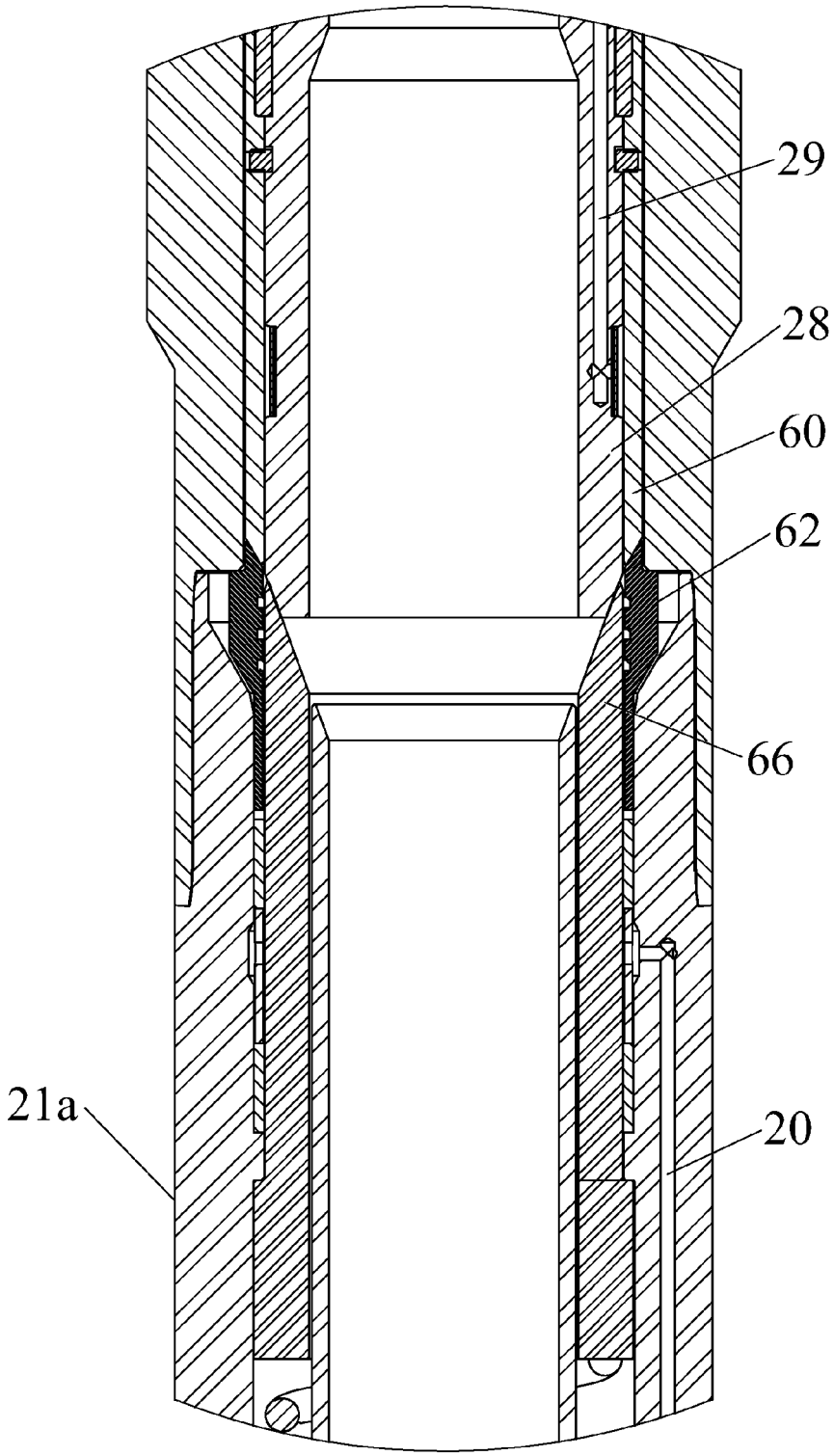
FIG. 6 is a detailed cut view of the top portion of the hydraulic connector engaged to the lower portion of the hydraulic connect.

FIG. 6 depicts a detailed cut view of the lower tubular portion 28 engaging the lower port cover 66 and the barrier seal assembly 62. The upper port cover 60 is engaged with the barrier seal assembly 62. The initial interaction between the first lower tubular body 21*a* and the lower tubular portion 28 can be seen in FIG. 7.

Figure 7:
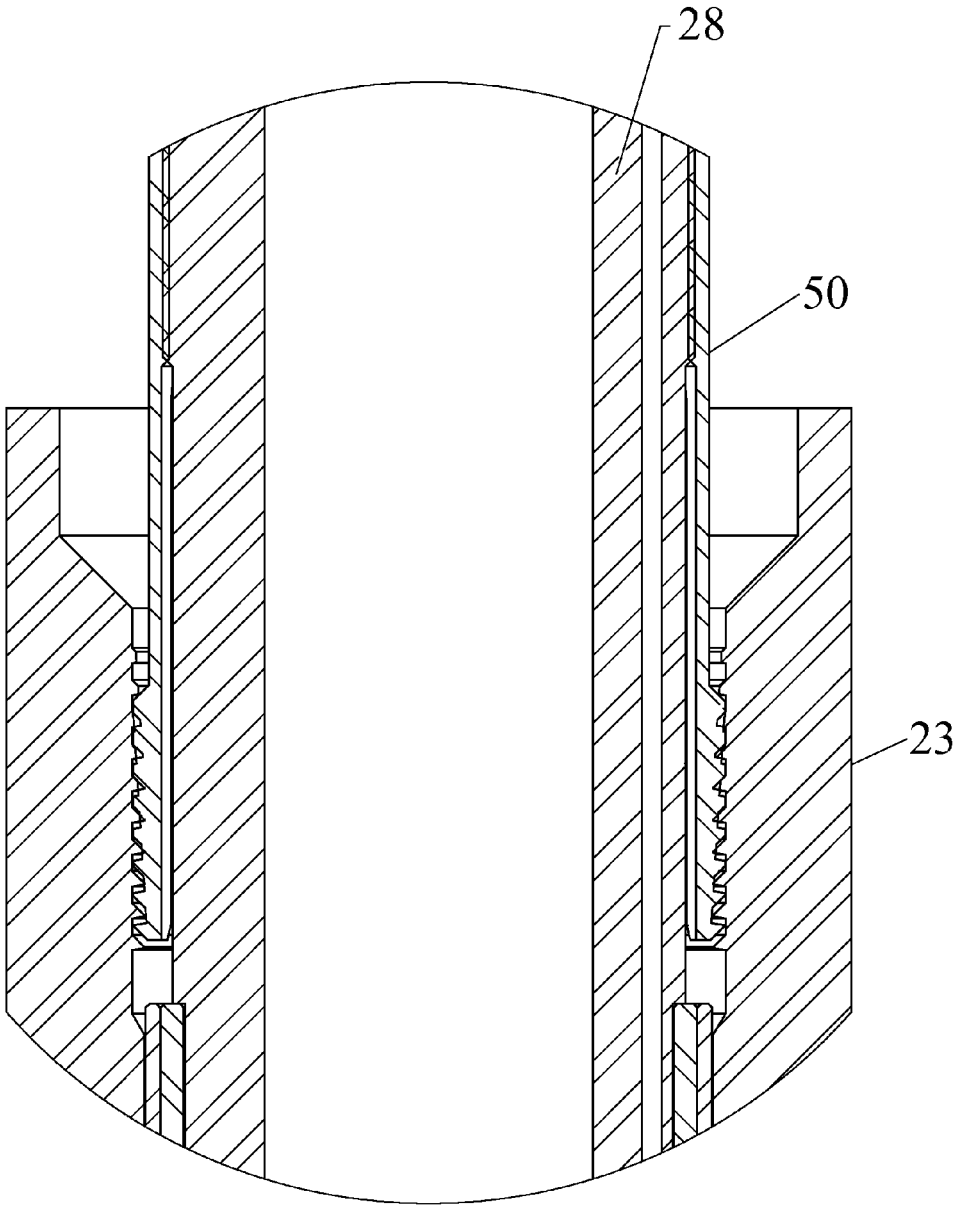
FIG. 7 is a detail view of the anchor mechanism when the top portion of the hydraulic connect is anchored to the lower portion.

FIG. 7 is a detail view of the anchor mechanism when the top portion of the hydraulic connect is anchored to the lower portion. The lower tubular portion 28 has an upper anchor 50 that removably fastens to the lower anchor 23. The upper anchor 50 removably fastens to the lower anchor 23 when the top portion 5 of hydraulic connect and seal assembly lands within the bottom portion 6 of hydraulic connect and double pin sub 6.

Figure 8:
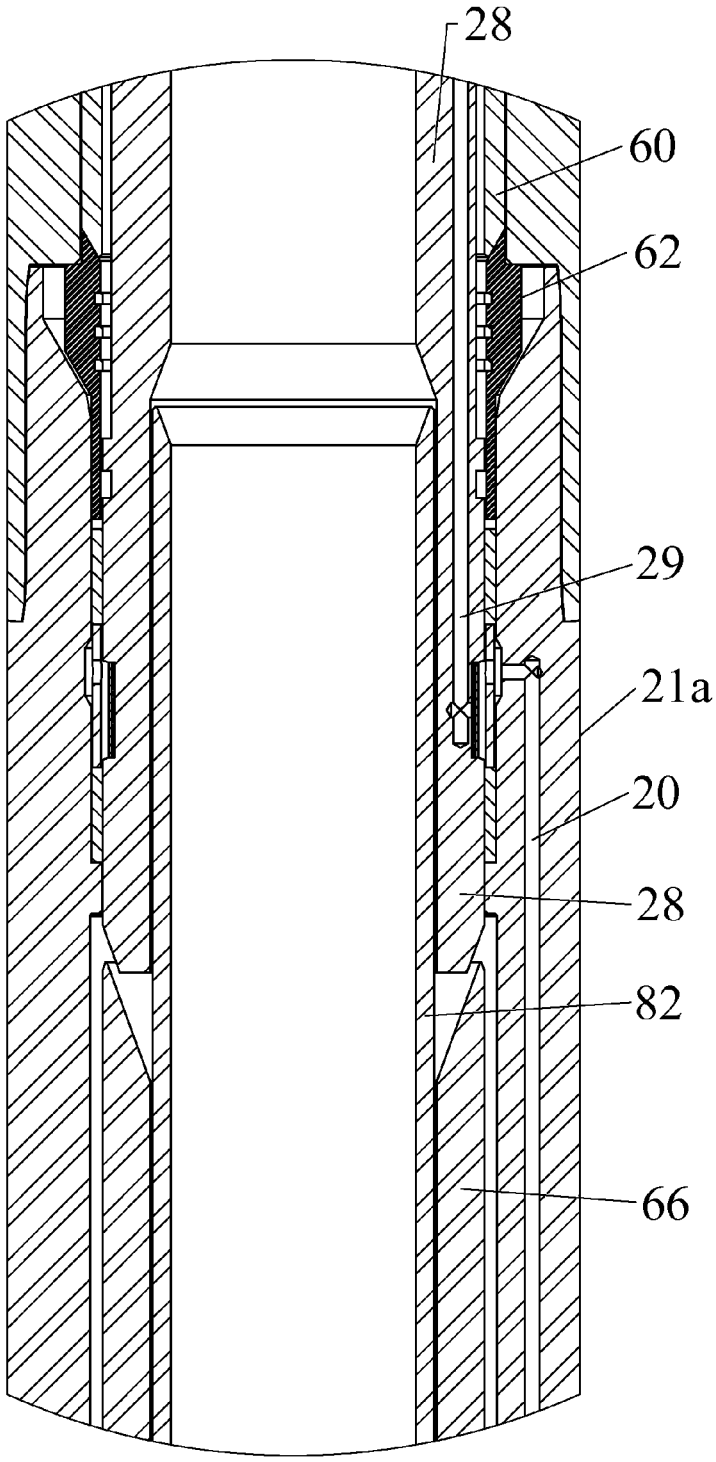
FIG. 8 is a detail view of the top portion of the hydraulic connector hydraulically communicated to the lower portion of the hydraulic connect when anchored.

FIG. 8 is a detail view of the top portion of the hydraulic connect hydraulically communicated to the lower portion of the hydraulic connect when anchored. The lower tubular portion 28 has an upper landing ring 52 fastened to the upper port cover 60. In FIG. 8 the upper landing ring 52 can not be seen because it has shifted up due to the upper cover 60 landing into the barrier seal assembly 62. This occurs while lower tubular portion 28 travels down into the first lower tubular body 21*a*. The intermediate hydraulic flow path 29 is in fluid communication with the lower hydraulic flow path 20. The lower port cover 66 is in an opened position.

Figure 9A:
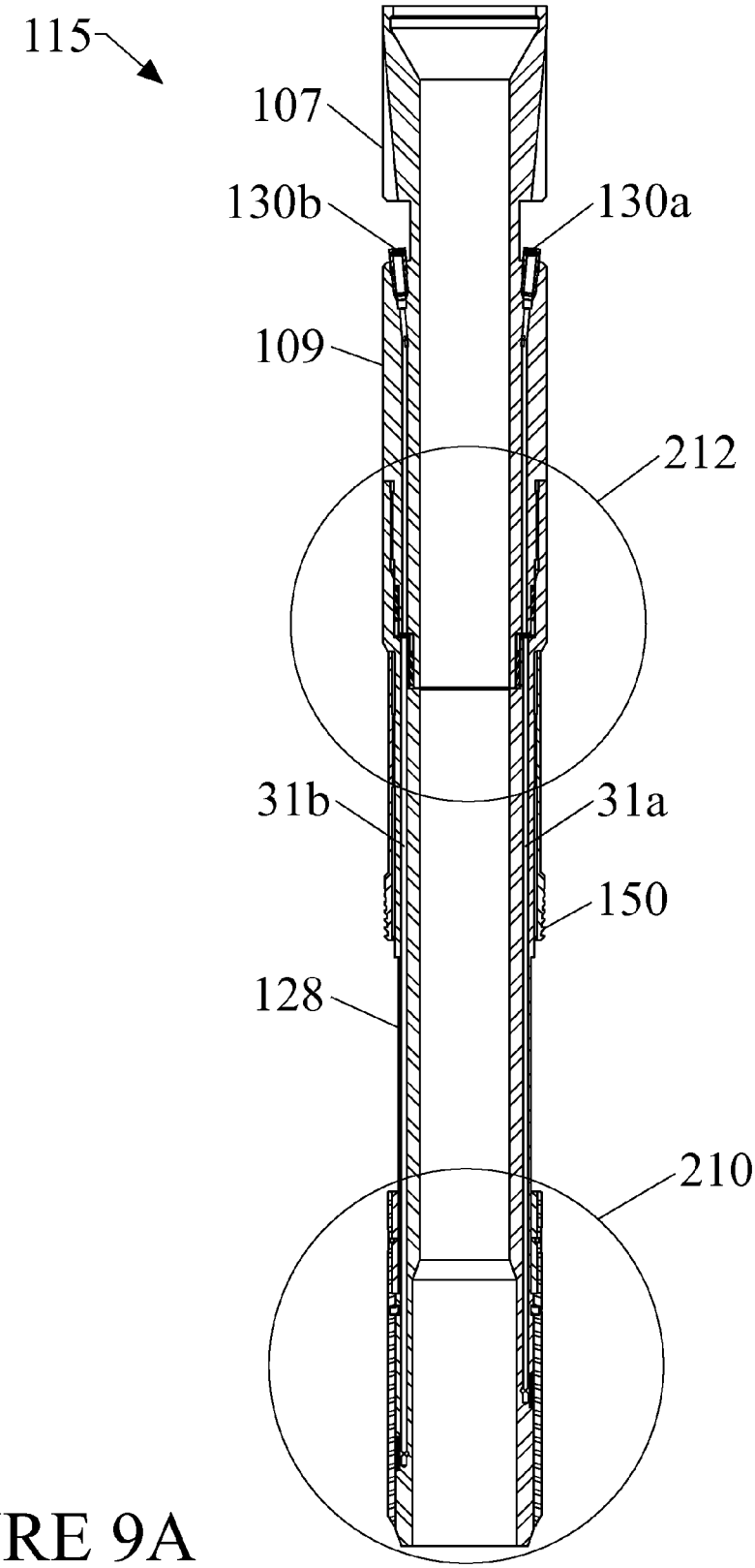
FIG. 9A depicts an embodiment of the double pin connector with hydraulic connect with a plurality of hydraulic flow paths.
Figure 9B:
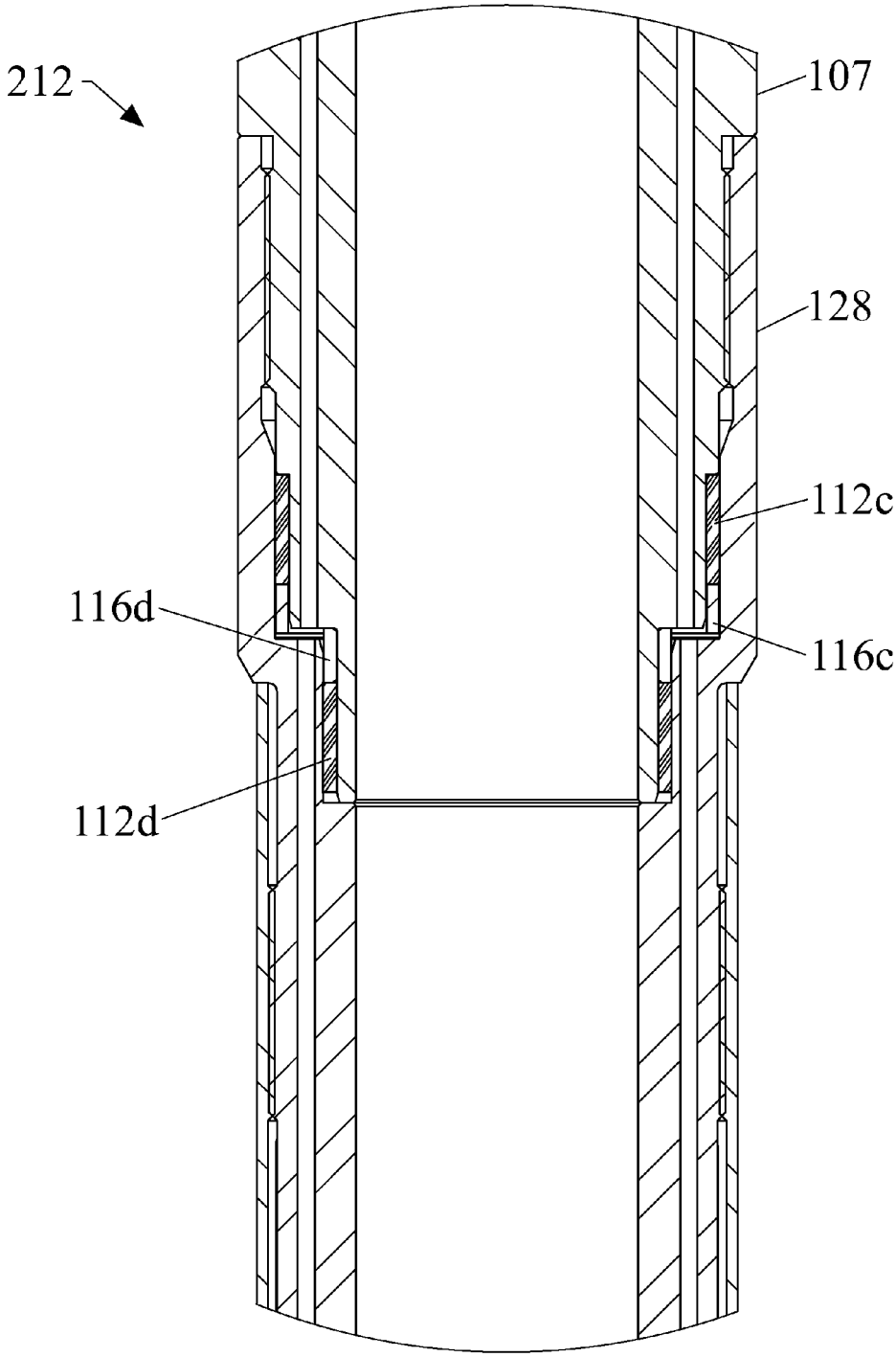
FIG. 9B depicts a detailed view of a top portion of the double pin connector with hydraulic connect with a plurality of hydraulic flow paths.

Referring now to FIGS. 9A and 9B, and embodiment of the double pin connector is depicted with a plurality of hydraulic connects. Particularly, a top portion 115 of the double pin hydraulic connector is depicted having an upper tubular portion 107 secured to a lower tubular portion 128. The upper tubular portion 107 has an outer surface 109.

A first upper hydraulic connector 130*a* and a second upper hydraulic connector 130*b* are connected to the upper tubular portion 107.

An upper anchor 150 is fastened to the lower tubular portion 128. The lower tubular portion 128 has a first upper hydraulic flow path 31*a* and a second hydraulic flow path 31*b* arranged in parallel. The first upper hydraulic flow path 31*a* is in fluid communication with the first hydraulic connector 130*a*. The second upper hydraulic connector 130*b* is in fluid communication with the second upper flow path 31*b*.

Section 212 is depicted in FIG. 9B. A first seal ring 116*c* is disposed between a first hydraulic flow path seal 112*c* and a lower tubular portion 128. The first hydraulic flow path seal 112*c* is disposed on the upper tubular portion 107.

A second hydraulic flow path seal 112*d* is disposed in the lower tubular portion 128. A second seal ring 116*d* is disposed between the upper tubular portion 107 and the second hydraulic flow path seal 112*d*.

Figure 10:
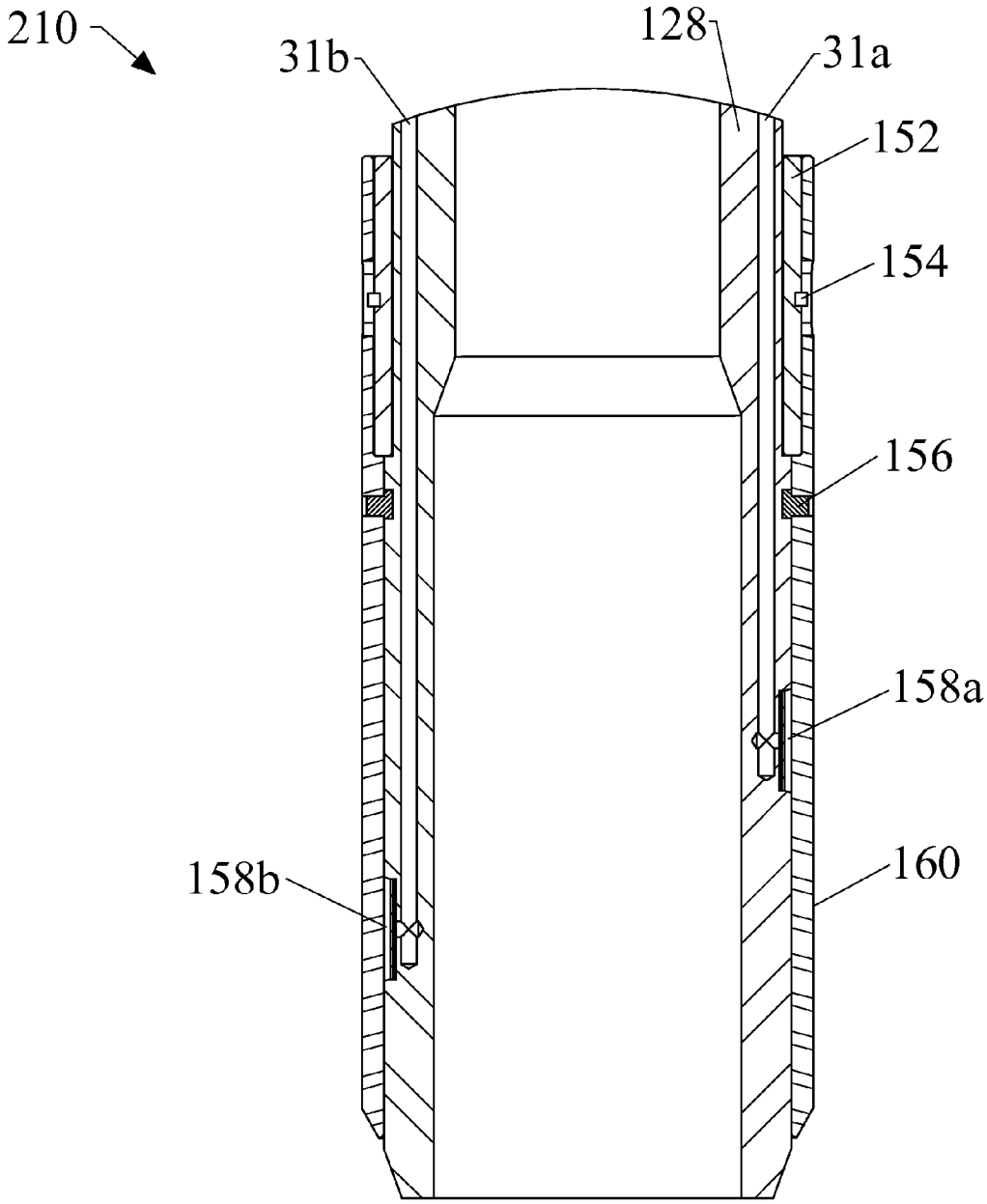
FIG. 10 depicts detailed view of a lower tubular portion with a plurality of hydraulic flow paths.

Section 210 is best seen in FIG. 10. Section 210 has a locking wire 154 secured to an upper port cover 160 and an upper landing ring 152. An upper fastener 156 connects to the upper port cover 160 to the lower tubular portion 128.

In FIG. 10 a first filter 158*a* and a second filter 158*b* are secured to the lower tubular portion 128 for providing filtration of the plurality of hydraulic flow paths.

Turning now to FIG. 1A, which depicts a bottom portion 116 of the double pin hydraulic connector. The bottom portion has at least one lower tubular body 121. An actuator guide 182 is disposed within the lower tubular body 121. An actuator 174 is disposed on the actuator guide 182. A first lower hydraulic flow path 120*a* is disposed in the lower tubular body 121. A second lower hydraulic flow path 120*b* is also disposed in the lower tubular body 121.

The first upper hydraulic flow path 31*a* is in fluid communication with the first lower hydraulic flow path 120*a*, and the second upper hydraulic flow path 31*b* is in fluid communication with the second lower hydraulic flow path 120*b* when the upper tubular portion 107 lands within the lower tubular body 121. In another embodiment the flow paths don't communicate until the upper tubular portion and the lower tubular portion anchor.

The first lower hydraulic flow path 120*a* is in fluid communication with a first lower hydraulic connector 147*a*. The second lower hydraulic flow path 120*b* is in fluid communication with a second lower hydraulic connector 147*b*.

Figure 11A:
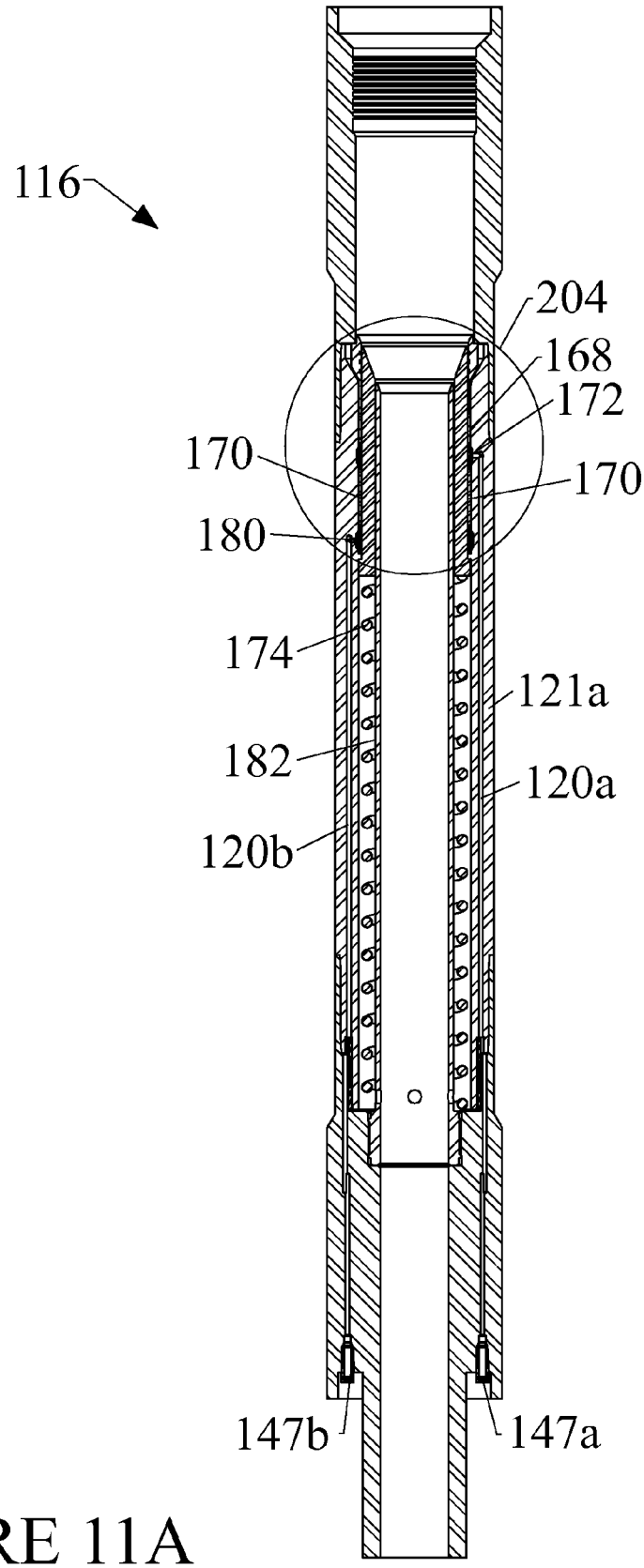
FIG. 11A depicts a bottom portion of the double pin connector with hydraulic connect with a plurality of hydraulic flow paths.
Figure 11B:
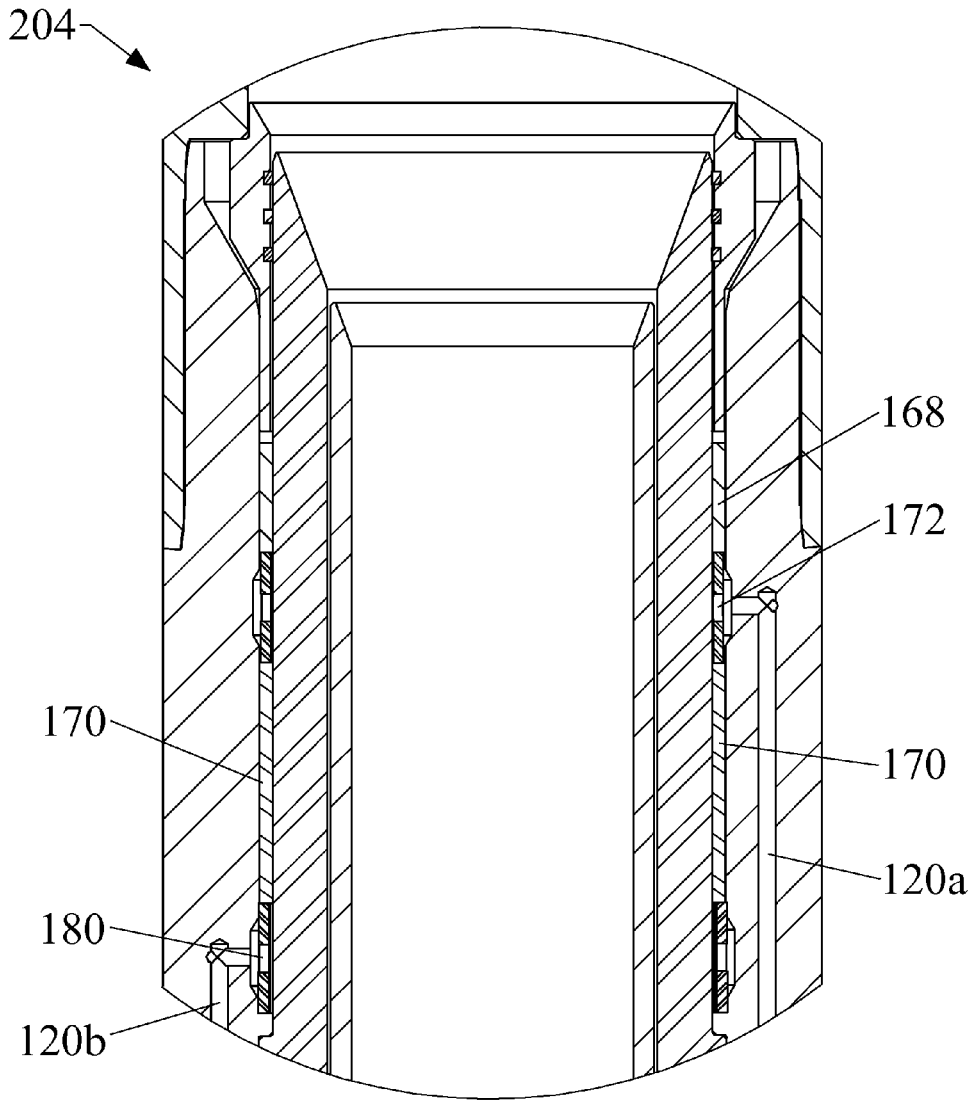
FIG. 11B depicts a detailed view of a segment of the bottom portion of the double pin connector with hydraulic connect with a plurality of hydraulic flow paths.

In section 204, which is depicted in detail in FIG. 11B, it can be seen that the first lower hydraulic flow path 120*a* has a first lower port seal 168, spaced apart from a second lower port seal 170 with a first lower port spacer 172. A space 180 is disposed between the lower tubular 121 and the second lower port seal 170.

In FIG. 11A, the actuator guide 182 can be seen within the lower tubular body 121. The actuator guide 182 is within the lower tubular body 121 and is surrounded by an actuator 174.

While these embodiments have been described with emphasis on the embodiments, it should be understood that within the scope of the appended claims, the embodiments might be practiced other than as specifically described herein.

What is claimed is:

1. A double pin connector with hydraulic connect and seal assembly comprising:

a. a top portion of a double pin connector with hydraulic connect and seal assembly comprising:

(i) an upper tubular portion engaged with an intermediate tubular portion wherein the intermediate tubular portion has an upper flow path in fluid communication with a first hydraulic connector and a plurality of seals comprising at least a first hydraulic flow path seal;

(ii) a plurality of concentric seals disposed on an outer surface of upper tubular portion and a plurality of concentric seals disposed on an outer surface of the intermediate tubular portion;

(iii) a lower tubular portion fastened to the intermediate tubular portion, and wherein the lower tubular portion comprises an intermediate hydraulic flow path in communication with the upper flow path, wherein the lower tubular portion comprises an upper anchor; and (iv) the first hydraulic connector adapted to be in fluid communication with a hydraulic fluid supply and fastened to the upper tubular portion; and b. a bottom portion of a double pin connector with hydraulic connect and seal assembly comprising:

(i) a lower anchor fastened to a first lower tubular body, the lower anchor comprising inward facing threads formed on the bottom tubular portion for connecting with outward facing threads of the upper anchor on the lower tubular portion, wherein an actuator guide is disposed within the first lower tubular body, and wherein a lower actuator is disposed on the actuator guide;

(ii) a second lower tubular body fastened to the actuator guide, with a double pin connector having an inner pin connector and an outer pin connector and wherein the second lower tubular body contains a lower hydraulic flow path in fluid communication with a second hydraulic line connector, wherein the second hydraulic line connector connects the lower hydraulic flow path downhole; and wherein the intermediate hydraulic flow path is in fluid communication with the lower hydraulic flow path when the top portion is disposed within the bottom portion, and wherein the double pin connector with hydraulic connect and seal assembly is adapted to provide hydraulic fluid downhole.

2. The double pin connector with hydraulic connect and seal assembly of claim 1, further comprising a first seal ring disposed between the first hydraulic flow path seal and intermediate tubular portion.

3. The double pin connector with hydraulic connect and seal assembly of claim 1, further comprising a second seal ring disposed between the upper tubular portion and a second hydraulic flow path seal.

4. The double pin connector with hydraulic connect and seal assembly of claim 1, further comprising an upper landing ring fastened to an upper port cover which is fastened to the lower tubular portion which engages a barrier seal assembly.

5. The double pin connector with hydraulic connect and seal assembly of claim 4, further comprising a locking wire connecting the upper port cover to the upper landing ring.

6. The double pin connector with hydraulic connect and seal assembly of claim 4, further comprising an upper fastener connecting the upper port cover to the lower tubular portion.

7. The double pin connector with hydraulic connect and seal assembly of claim 1, further comprising a barrier seal assembly disposed between the lower anchor and the first lower tubular body.

8. The double pin connector with hydraulic connect and seal assembly of claim 7, wherein the barrier seal assembly comprises at least one barrier seal disposed within a seal housing.

9. The double pin connector with hydraulic connect and seal assembly of claim 1, further comprising a first lower seal ring and second lower seal ring disposed between the first lower tubular body and the second lower tubular body.

10. The double pin connector with hydraulic connect and seal assembly of claim 1, wherein the first lower tubular portion comprises a first lower port seal, spaced apart from a second lower port seal with a lower port spacer.

11. A double pin connector with hydraulic connect and seal assembly comprising:

a. a top portion of a double pin connector with hydraulic connect and seal assembly comprising:
   (i) an upper tubular portion;
   (ii) a plurality of upper concentric seals disposed on an outer surface of the upper tubular portion; and
   (iii) a first hydraulic connector adapted to be in fluid communication with a hydraulic fluid supply and fastened to the upper tubular portion, the first hydraulic connector is adapted to be in fluid communication with a hydraulic fluid flow path;

b. a bottom portion of a double pin connector with hydraulic connect and seal assembly comprising:
   (i) a lower tubular body with a double pin connector having an inner pin connector and an outer pin connector at the end of the lower tubular body;
   (ii) a flow path is disposed in the lower tubular body isolated from other hydraulic flow paths by at least one lower port seal; and
   (iii) a second hydraulic line connector connected to the lower tubular body, wherein the second hydraulic line connector is in fluid communication with the lower tubular body, and adapted to provide hydraulic fluid downhole;

wherein the first hydraulic line connector is in fluid communication with the second hydraulic line connector when the top portion is disposed within the bottom portion and wherein the double pin connector with hydraulic connect and seal assembly is adapted to provide hydraulic fluid downhole.

12. The double pin connector with hydraulic connect and seal assembly of claim 11, wherein the lower tubular body comprises a first lower tubular body connected to a second lower tubular body.

13. The double pin connector with hydraulic connect and seal assembly of claim 11, further comprising an actuator guide disposed in the lower tubular body, and wherein an actuator is disposed on the actuator guide.

14. A double pin connector with hydraulic connects comprising:

a. a top portion of a double pin connector with hydraulic connect comprising:
   (i) an upper tubular portion comprises a plurality of hydraulic connectors secured to the upper tubular portion and adapted to be in fluid communication with a hydraulic fluid supply; and
   (ii) a plurality of hydraulic flow paths disposed within the upper tubular portion, wherein the plurality of hydraulic flow paths are arranged in parallel in fluid communication with the plurality of hydraulic connectors;

b. a bottom portion of a double pin connector with hydraulic connect and seal assembly comprising:
   (i) a lower tubular body with a double pin connector having an inner pin connector and an outer pin connector at the end of the lower tubular body;
   (ii) a plurality of lower hydraulic flow paths disposed in the lower tubular body;
   wherein each of the lower hydraulic flow paths are isolated from the other hydraulic flow paths by at least one lower port seal;
   (iii) a plurality of lower line connectors in fluid communication with the lower hydraulic flow paths for providing hydraulic fluid downhole; and
   (iv) wherein the plurality of upper hydraulic flow paths are in fluid communication with the lower hydraulic flow paths when the upper tubular portion lands within the lower tubular portion.

15. The double pin connector of claim 14, wherein each lower hydraulic flow path is isolated by a first lower port seal disposed on the lower tubular body, and wherein the first lower port seal is spaced apart from a second lower port seal with a lower port spacer.

16. The double pin connector of claim 14, wherein an upper anchor is fastened to the top portion, and wherein the upper anchor is adapted to engage the lower portion.

17. The double pin connector of claim 14, wherein at least one filter is secured to the lower tubular portion for providing filtration of the plurality of hydraulic flow paths.

* * * * *